US009545546B2

(12) United States Patent
Li

(10) Patent No.: US 9,545,546 B2
(45) **Date of Patent: *Jan. 17, 2017**

(54) METHOD FOR MANUFACTURING A LOW-DENSITY STEEL WOODEN GOLF HEAD

(71) Applicant: FUSHENG PRECISION CO., LTD., Taipei (TW)

(72) Inventor: Chien-Liang Li, Taipei (TW)

(73) Assignee: Fusheng Precision Co., Ltd., Taipei (TW)

( * ) Notice: Subject to any disclaimer, the term of this patent is extended or adjusted under 35 U.S.C. 154(b) by 118 days.

This patent is subject to a terminal disclaimer.

(21) Appl. No.: 14/576,475

(22) Filed: Dec. 19, 2014

(65) Prior Publication Data

US 2015/0182820 A1 Jul. 2, 2015

(30) Foreign Application Priority Data

Dec. 31, 2013 (TW) ..... 102149295 A

(51) Int. Cl.
*B22C 9/04* (2006.01)
*B22D 13/06* (2006.01)
(Continued)

(52) U.S. Cl.
CPC ..... *A63B 53/0466* (2013.01); *B22C 9/043* (2013.01); *B22D 13/06* (2013.01); *B22D 13/101* (2013.01);
(Continued)

(58) Field of Classification Search
CPC ..... B22C 9/04; B22C 9/043; B22D 13/04; B22D 13/101; B22D 13/107; B22D 13/108
(Continued)

(56) References Cited

U.S. PATENT DOCUMENTS 7,513,296 B1 * 4/2009 Yu et al. ..... B22C 9/04 164/35
8,167,023 B2 5/2012 Renkel
(Continued)

FOREIGN PATENT DOCUMENTS

JP H09253245 A 9/1997
JP H1136029 A 2/1999
(Continued)

*Primary Examiner* — Kevin P Kerns
(74) *Attorney, Agent, or Firm* — Alan D. Kamrath; Kamrath IP Lawfirm, P.A.

(57) ABSTRACT

A method for manufacturing a low-density steel wooden golf head solves the difficulty in reducing the thickness of a conventional wooden golf head. The method includes placing a shell mold having a crucible portion and a cavity portion in communication with the crucible portion on a rotary table, placing a metal ingot into the crucible portion, followed by melting the metal ingot in molten metal in a vacuum environment, rotating the rotary table to cause the molten metal to flow into the cavity portion under a centrifugal force, gradually slowing down the rotary table after the molten metal cools and solidifies, destroying the shell mold to obtain a casting including a cast product portion, and separating the cast product portion from the casting to obtain a casting product of a wooden golf head having a density of 6.5-7.6 g/cm$^3$ and a minimum thickness of 0.4-0.6 mm.

9 Claims, 7 Drawing Sheets

(51) Int. Cl.
*B22D 13/10* (2006.01)
*A63B 53/04* (2015.01)

(52) U.S. Cl.
CPC ..... *B22D 13/107* (2013.01); *B22D 13/108* (2013.01); *A63B 2209/00* (2013.01)

(58) Field of Classification Search
USPC ..... 164/35, 61, 114
See application file for complete search history.

(56) References Cited

U.S. PATENT DOCUMENTS

| | | | | |
|---|---|---|---|---|
| 8,636,609 | B2 | 1/2014 | Chao et al. | |
| 2003/0042001 | A1* | 3/2003 | Ray et al. | B22C 3/00 164/529 |
| 2010/0003159 | A1 | 1/2010 | Liu et al. | |
| 2011/0061772 | A1 | 3/2011 | Liu et al. | |
| 2011/0094705 | A1* | 4/2011 | Kelly et al. | B22D 13/00 164/493 |
| 2015/0182819 | A1* | 7/2015 | Li | A63B 53/0466 164/35 |

FOREIGN PATENT DOCUMENTS

| | | | |
|---|---|---|---|
| JP | 2002301553 | A | 10/2002 |
| JP | 2008136870 | A | 6/2008 |
| TW | 201215467 | A1 | 4/2012 |

* cited by examiner

METHOD FOR MANUFACTURING A LOW-DENSITY STEEL WOODEN GOLF HEAD

BACKGROUND OF THE INVENTION

1. Field of the Invention

The present invention generally relates to a method for manufacturing a wooden golf head and, more particularly, to a method for manufacturing a low-density steel golf head with a reduced thickness.

2. Description of the Related Art

Early wooden golf heads are made of stainless or carbon steel. In order to increase the performance of the wooden golf heads, several new steel-type casting materials have been continuously developed in recent years and have been used to manufacture wooden golf heads. For example, steel-type alloys containing aluminum (Al), silicon (Si), or manganese (Mn) generally have a low density below 7.6 g/cm$^3$. Therefore, such steel-type alloys are suitable for manufacturing the wooden golf heads, which decrease the total weight of the wooden golf heads and improve the hitting effect of the wooden golf heads.

Current wooden golf heads are manufactured by using a high frequency induction furnace to rapidly melt the casting materials in the atmosphere, followed by removing the slag and gases in the molten metal by slagging and refinery. Static gravity pouring is then carried out. However, the casting materials for the low-density wooden golf heads include active metals, such as aluminum or manganese that are apt to react with oxygen in the air. Thus, rigorous oxidation easily occurs during the procedures of smelting of the casting materials, increasing difficulties in melting and easily causing oxidative fire cracks due to reaction with air during the pouring process. As a result, appearance defects, such as sesame dot defects and black bean defects, are apt to be formed on the cast products of the wooden golf heads. In worse situations, the reactive gas forms a large number of slag holes or blowholes in the cast products of the wooden golf heads and, thus, adversely affects the tensile strength of the wooden golf heads.

Furthermore, rigorous oxidation also reduces the flowability of the molten metal in the shell mold, leading to a reduced yield rate of the cast products of the wooden golf heads due to insufficient pouring or resulting in gaps in the cast products of the wooden golf heads due to cold shut. The tensile strength of the cast products of the wooden golf heads is also adversely affected.

Therefore, the thickness of the wooden golf heads manufactured by static gravity pouring in the atmosphere should be thick enough to improve the yield rate, and the forced shaping cast products are easily destroyed due to the inadequate structural strength. That is to say, the average thickness of the entire integrally shaped wooden golf heads is relatively thick, and therefore, the wooden golf heads manufactured with low-density casting materials still have a relative high weight.

On the other hand, on the wooden golf heads manufactured by static gravity pouring, additional casting materials are needed to elevate the pressing effect of the molten metal and to improve the yield rate of the wooden golf heads. However, the additional casting materials and the energy used for melting the additional casting materials result in the increased manufacturing cost.

In light of this, it is necessary to improve the conventional method for manufacturing a steel golf head.

SUMMARY OF THE INVENTION

It is therefore the objective of an embodiment of the present invention to provide a method for manufacturing a low-density steel golf head to reduce the chemical reaction of the casting material with air during the smelting process, thereby increasing the tensile strength of the cast products and reducing the thickness of entire wooden golf heads.

It is another objective of an embodiment of the invention to provide a method for manufacturing a low-density steel golf head to increase the yield rate and quality of the cast products.

It is yet another objective of an embodiment of the invention to provide a method for manufacturing a low-density steel golf head to reduce the manufacturing cost without using additional casting materials for maintaining the pressing effect of the molten metal.

The present invention fulfills the above objectives by providing a method for manufacturing a low-density steel wooden golf head, which includes the following steps. A shell mold containing a crucible portion and a cavity portion in communication with the crucible portion via a connecting portion is placed on a rotary table. The cavity portion includes a hosel-shaping region, a crown-shaping region, a skirt-shaping region, a heel-shaping region, a sole-shaping region and a toe-shaping region, while the hosel-shaping region, the crown-shaping region, the skirt-shaping region, the heel-shaping region, the sole-shaping region and the toe-shaping region interconnect with each other. At least one metal ingot is placed in the crucible portion of the shell mold, and is melted into molten metal in a vacuum environment. The rotating shaft is driven to rotate the rotary table, causing the molten metal to flow into the cavity portion of the shell mold under centrifugal force generated by rotation. After the molten metal cools and solidifies, the rotating shaft is gradually slowed down, followed by destroying the shell mold after the molten metal completely solidifies. A casting with a cast product portion is obtained. The cast product portion is separated from the casting to obtain at least one casting product of a wooden golf head having a hosel, a crown, a skirt, a heel, a sole and a toe corresponding to the hosel-shaping region, the crown-shaping region, the skirt-shaping region, the heel-shaping region, the sole-shaping region and, the toe-shaping region, respectively. The at least one casting product of the wooden golf head has a density of 6.5-7.6 g/cm$^3$ and a minimum thickness of 0.4-0.6 mm.

In a preferred form shown, formation of the shell mold further includes the following substeps. A wax blank with a crucible blank and a casting blank is prepared. The wax blank further has a coupling blank in communication with an outer periphery of the crucible blank and the casting blank. The casting blank is a hollow wax shell having an opening connecting an interior thereof. An enveloping layer is formed on an outer surface of the wax blank. The wax blank and the enveloping layer are heated to melt the wax. The dewaxed enveloping layer is sintered at a high temperature to form an integrally formed shell mold with the crucible portion, the cavity portion and the connecting portion.

In a preferred form shown, the casting blank contains a hosel-shaping portion, a heel-shaping portion coupling with the hosel-shaping portion, a sole-shaping portion coupling with the heel-shaping portion and a toe-shaping portion coupling with the sole-shaping portion. The casting blank further includes a crown-shaping portion coupling with the hosel-shaping portion, the toe-shaping portion and a skirt-shaping portion.

In a preferred form shown, the casting blank has an opening installed among the crown-shaping portion, the heel-shaping portion, the sole-shaping portion and the toe-shaping portion.

In a preferred form shown, the method further includes melting the at least one metal ingot in the crucible portion of the shell mold into molten metal in the vacuum environment with an activated heater surrounding the crucible portion of the shell mold.

In a preferred form shown, the method further includes moving the activated heater upward to a preset location surrounding the crucible portion by a lift controller and moving the activated heater downward to a position not surrounding the crucible portion by the lift controller after the at least one metal ingot is melted into molten metal.

In a preferred form shown, the method further includes rotating the rotary table at a speed of 200-700 rpm to allow the molten metal to flow into the cavity portion of the shell mold and fill the cavity portion of the shell mold.

In a preferred form shown, the method further includes maintaining the rotating speed of the rotary table at 200-700 rpm for 10-30 seconds. The rotary table is then gradually slowed down and stopped after the molten metal in the coupling portion of the shell mold cools and solidifies.

In a preferred form shown, the method further includes removing the shell mold from the rotary table after the rotating shaft is completely stopped. The shell mold is destroyed after the shell mold is restricted from movement for a period of time until the molten metal completely solidifies. Alternatively, the method further includes constantly cooling the shell mold on the rotary table after the rotary table stops rotating. The shell mold can be then removed from the rotary table and be destroyed after the molten metal in the shell mold completely solidifies.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

Figure 1:
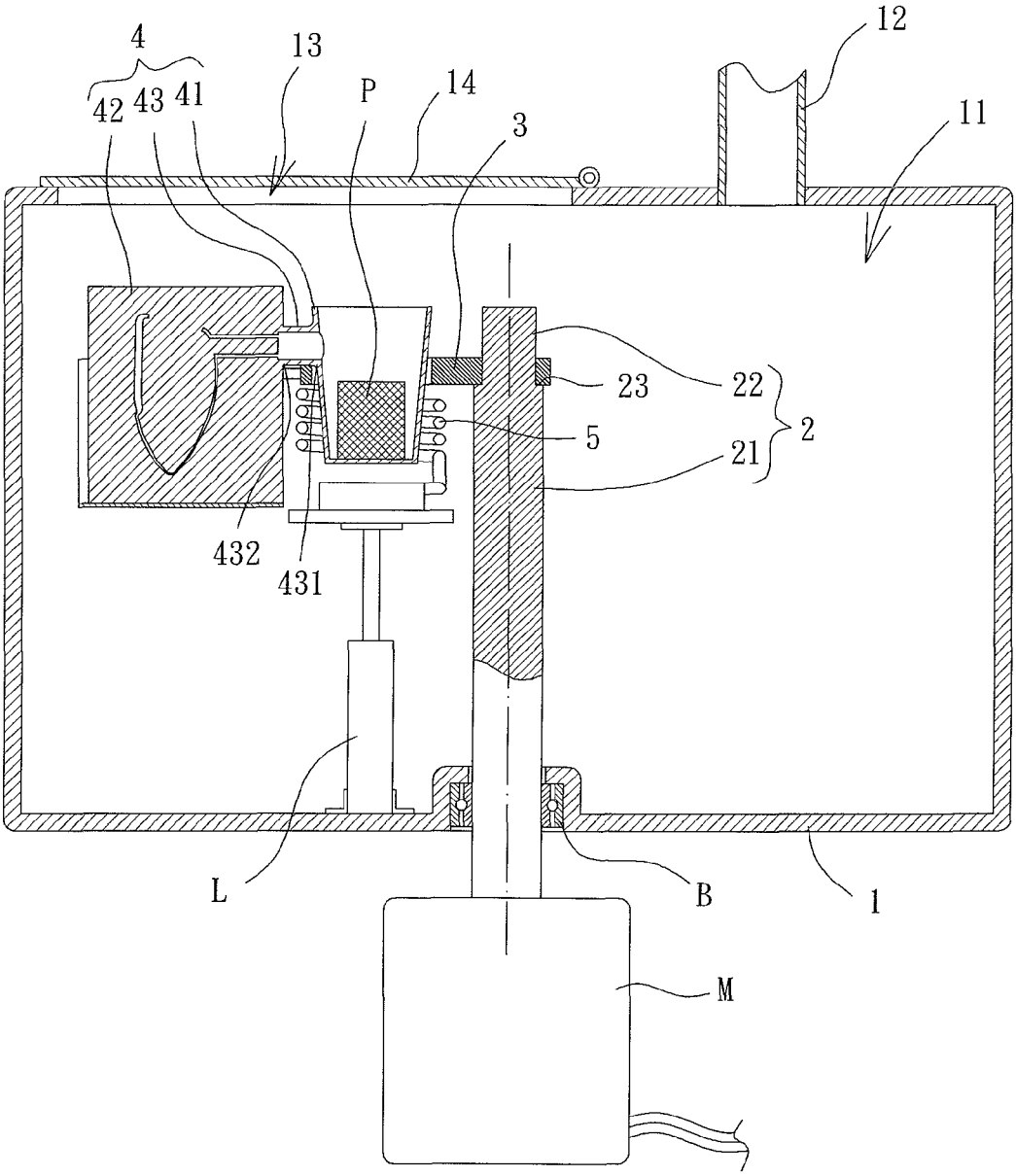
FIG. 1 is a diagrammatic cross sectional view of a vacuum centrifugal casting device capable of carrying out a method for manufacturing a low-density steel wooden golf head according to the present invention.

In the various figures of the drawings, the same numerals designate the same or similar parts. Furthermore, when the term "first", "second", "third", "fourth", "inner", "outer", "top", "bottom" and similar terms are used hereinafter, it should be understood that these terms refer only to the structure shown in the drawings as it would appear to a person viewing the drawings, and are utilized only to facilitate describing the invention.

DETAILED DESCRIPTION OF THE INVENTION

FIG. 1 is a diagrammatic cross sectional view of a vacuum centrifugal casting device capable of carrying out a method for manufacturing a low-density steel wooden golf head according to the present invention. The vacuum centrifugal casting device includes a vacuum furnace 1, a rotating shaft 2, a rotary table 3, a shell mold 4 and a heater 5. The rotating shaft 2, the rotary table 3, the shell mold 4 and the heater 5 are mounted in the vacuum furnace 1. The rotary table 3 is connected to the rotating shaft 2 to rotate synchronously with the rotating shaft 2. The shell mold 4 is placed on the rotary table 3. The heater 5 is used to heat the shell mold 4.

Specifically, the vacuum furnace 1 includes a chamber 11. A gas-guiding tube 12 can be mounted to the vacuum furnace 1 and intercommunicates with the chamber 11. A vacuum controller (not shown) can be operated to control the vacuum level in the chamber 11 by drawing gas out of the chamber 11 via the gas-guiding tube 12 according to the preset values. Furthermore, the vacuum furnace 1 can include an opening 13, permitting a user to place an object into the chamber 11 or retrieve the object out of the chamber 11, and a cover 14 can be provided to open or close the opening 13.

Figure 2:
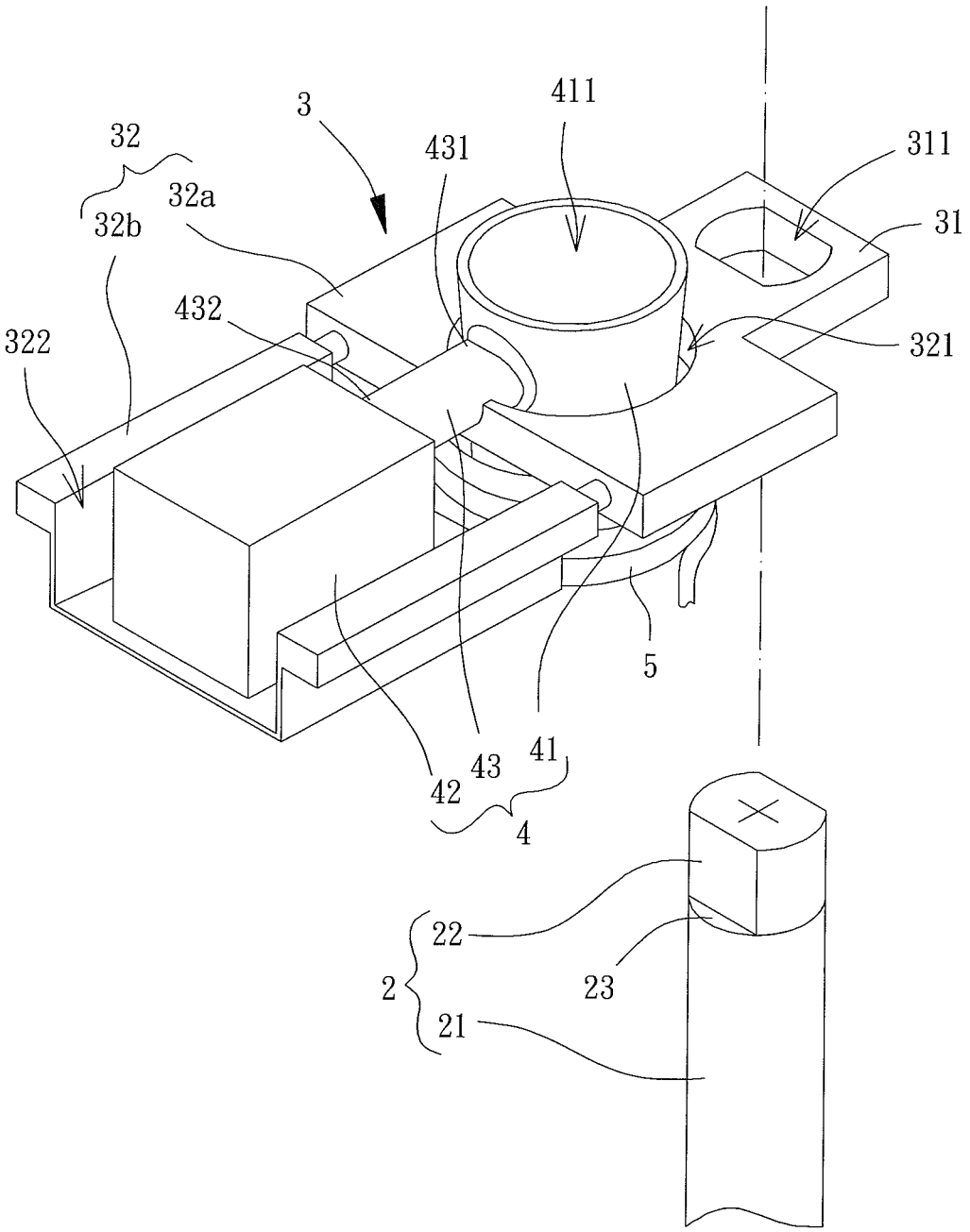
FIG. 2 is an exploded, perspective view of a portion of the vacuum centrifugal casting device of FIG. 1.

With reference to FIGS. 1 and 2, the rotating shaft 2 is mounted in the chamber 11 of the vacuum furnace 1 and is rotatable about a rotating axis. In this embodiment, the rotating shaft 2 is coupled to an output end of a motor "M" and can be driven by the motor "M" to rotate. The motor "M" can be mounted outside of the vacuum furnace 1, and an end of the rotating shaft 2 extends outside of the vacuum furnace 1 and is connected to the motor "M". The rotating shaft 2 can be received in a bearing "B" fixed to the vacuum furnace 1, increasing rotating stability of the rotating shaft 2 and preventing wobbling of the rotating shaft 2 during rotation.

Furthermore, a portion of the rotating shaft 2 in the chamber 11 can include a body 21 and a stop portion 22. Cross sections of the body 21 perpendicular to the rotating axis are different from cross sections of the stop portion 22 perpendicular to the rotating axis, forming an abutment portion 23 at an intersection between the body 21 and the stop portion 22. The rotary table 3 is coupled to the stop portion 22 and abuts the abutment portion 23 such that the rotary table 3 synchronously rotates with the rotating shaft 2. In this embodiment, the cross sections of the body 21 perpendicular to the rotating axis are circular. The stop portion 22 is located on an end of the rotating shaft 2, and the cross sections of the stop portion 22 perpendicular to the rotating axis are non-circular, allowing the rotary table 3 to couple with the stop portion 22 and to abut the abutment portion 23.

Figure 3:
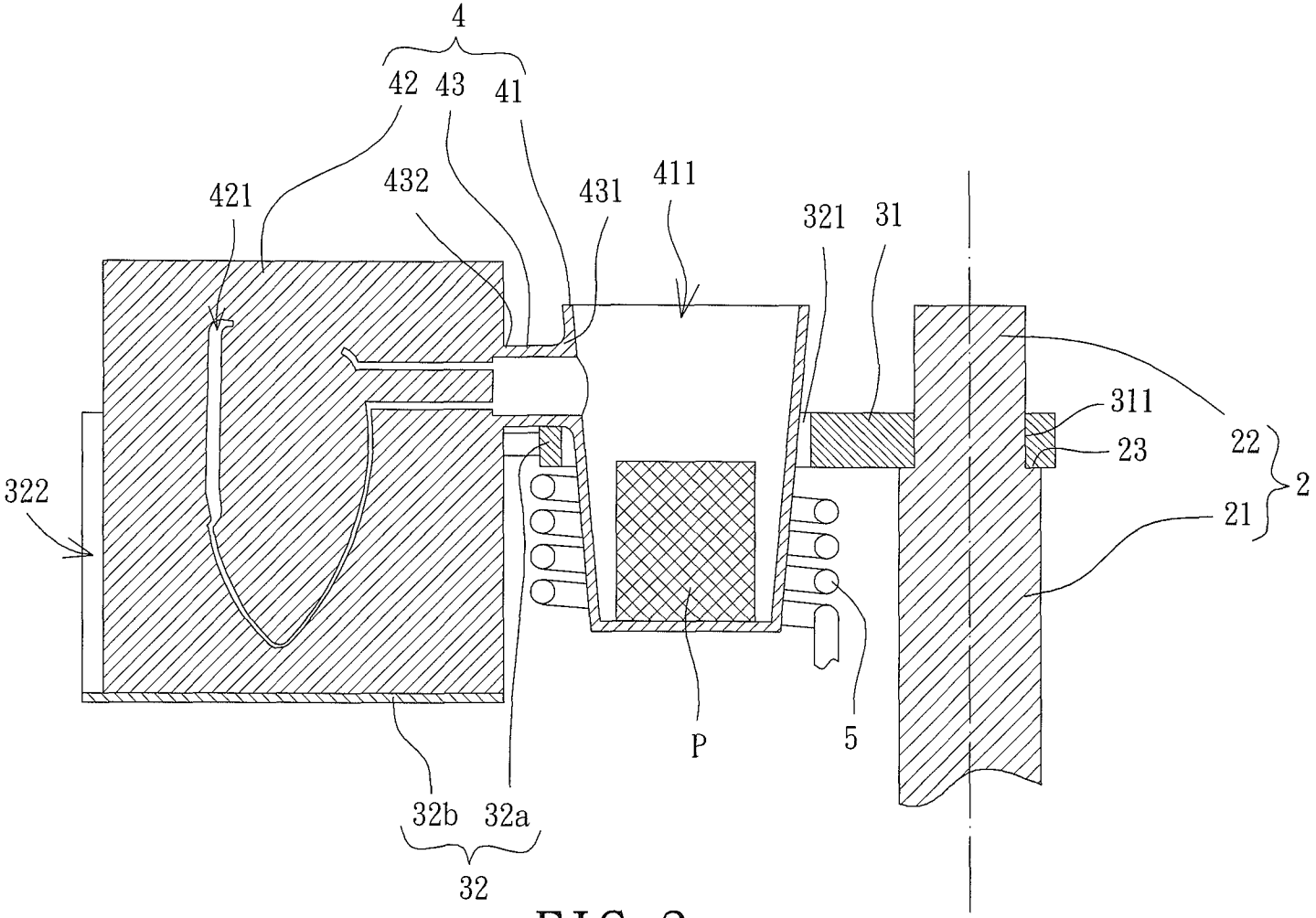
FIG. 3 is a diagrammatic cross sectional view of the portion of the vacuum centrifugal casting device of FIG. 2, illustrating a step of the method according to the present invention.

With reference to FIGS. 2 and 3, the rotary table 3 is a carrier on which the shell mold 4 is placed and positioned. The rotary table 3 includes a shaft-coupling portion 31 and a positioning portion 32 coupling with the shaft-coupling portion 31. In this embodiment, the shaft-coupling portion 31 can include a through-hole 311 having cross sections corresponding to the cross sections of the stop portion 22 of the rotating shaft 2. Thus, the through-hole 311 of the shaft-coupling portion 31 of the rotary table 3 receives the stop portion 22 of the rotating shaft 2 for coupling purposes. The positioning portion 32 of the rotary table 3 can be roughly divided into a crucible-positioning portion 32*a* and a cavity-positioning portion 32*b*. The crucible-positioning portion 32*a* is located between the shaft-coupling portion 31 and the cavity-positioning portion 32*b*. Furthermore, the shaft-coupling portion 31, the crucible-positioning portion 32*a* and the cavity-positioning portion 32*b* are arranged in a radial direction perpendicular to the rotating axis. Furthermore, the crucible-positioning portion 32*a* can include a receiving hole 321 for receiving a portion of the shell mold 4. The cavity-positioning portion 32*b* can include a compartment 322 receiving another portion of the shell mold 4.

Referring to FIGS. 2 and 3, the shell mold 4 includes a crucible portion 41, a cavity portion 42 and a coupling portion 43. The crucible portion 41 can be substantially cup-shaped and defines a receiving space 411 adapted for receiving metal ingots to be heated to melt. The cavity portion 42 is used to form a wooden golf head. However, the outline of the cavity portion 42 is not limited thereto. The cavity portion 42 includes at least one cavity 421 having a shape corresponding to a shape of the wooden golf head to be cast. The cast product of the wooden golf head is integrally formed except for the face of the cast product. That is, the cast product of the wooden golf head includes a hosel, a crown, a skirt, a heel, a sole and a toe. Therefore, the corresponding cavity 421 includes a hosel-shaping region, a crown-shaping region, a skirt-shaping region, a heel-shaping region, a sole-shaping region and a toe-shaping region, with the hosel-shaping region, the crown-shaping region, the skirt-shaping region, the heel-shaping region, the sole-shaping region and the toe-shaping region interconnecting with each other. The coupling portion 43 is tube-shaped with a first end 431 penetrating an outer periphery of the crucible portion 41 and in communication with the receiving space 411, with a second end 432 in communication with the cavity portion 42 and the cavity 421. With such performance, the receiving space 411 of the crucible portion 41 is in communication with the at least one cavity 421 of the cavity portion 42.

The crucible portion 41 and the cavity portion 42 of the shell mold 4 can be positioned in the crucible-positioning portion 32*a* and the cavity-positioning portion 32*b* of the rotary table 3, respectively, and, therefore, the crucible portion 41 is closer to the shaft-coupling portion 31 of the rotary table 3 than the cavity portion 42 is to the shaft-coupling portion 31 of the rotary table 3. Thus, as the rotary table 3 is driven to rotate, casting materials received in the receiving space 411 of the crucible portion 41 can flow into the at least one cavity 421 of the cavity portion 42 under centrifugal force.

Figure 4:
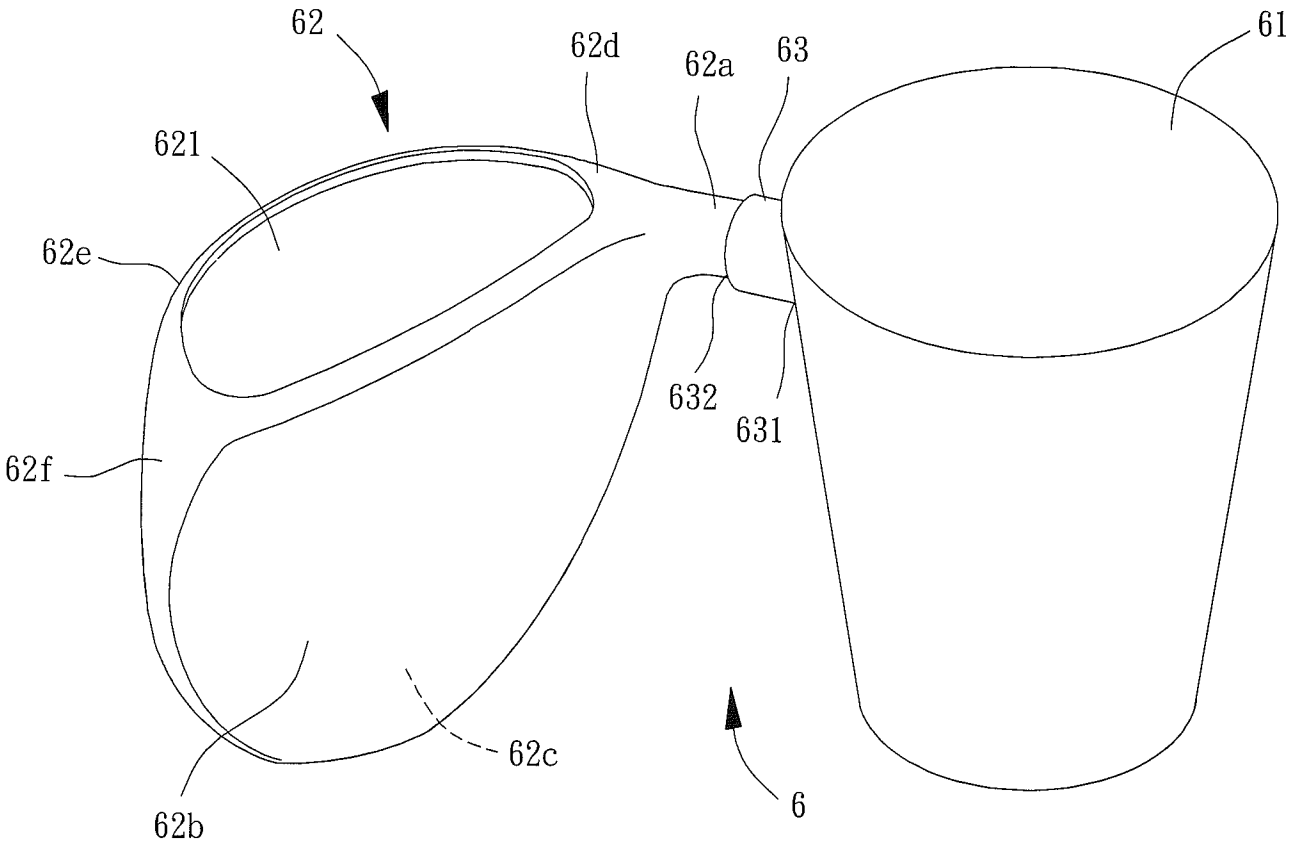
FIG. 4 is a perspective view of a wax blank for forming a shell mold of the vacuum centrifugal casting device of FIG. 2.
Figure 5:
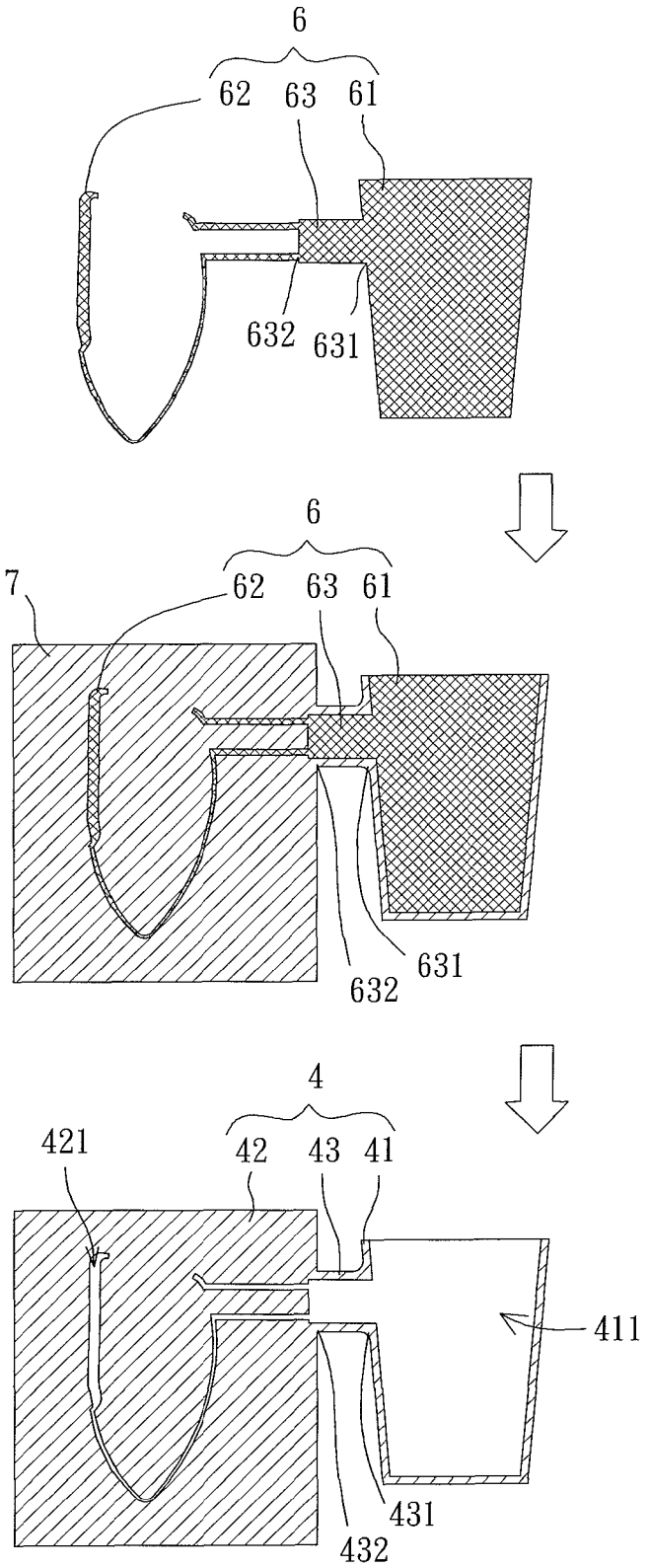
FIG. 5 shows procedures for forming a shell mold of the vacuum centrifugal casting device of FIG. 2.

With reference to FIGS. 4 and 5, in this embodiment, the crucible portion 41, the cavity portion 42 and the coupling portion 43 of the shell mold 4 are integrally connected to each other. Formation of the shell mold 4 includes preparing a wax blank 6 including a crucible blank 61, a casting blank 62 and a coupling blank 63. The crucible blank 61 and the coupling blank 63 are solid wax, while the casting blank 62 is a hollow wax shell. The coupling blank 63 has a first end 631 coupled with the outer periphery of the crucible blank 61 and a second end 632 coupled with the casting blank 62. The casting blank 62 can be roughly divided into a hosel-shaping region 62*a*, a crown-shaping region 62*b*, a skirt-shaping region 62*c*, a heel-shaping region 62*d* coupling with the hosel-shaping portion 62*a*, a sole-shaping region 62*e* coupling with the heel-shaping region 62*d* and a toe-shaping region 62*f* coupling with the sole-shaping region 62*e*. The crown-shaping region 62*b* couples with the hosel-shaping region 62*a*, the skirt-shaping region 62*c* and the toe-shaping region 62*f*. In addition, the casting blank 62 has an opening 62*l* among the crown-shaping region 62*b*, the heel-shaping region 62*d*, the sole-shaping region 62*e* and the toe-shaping region 62*f*, such that a striking faceplate can be mounted at the opening 62*l* of the at least one cast product.

It's worth to mention that any portion of the casting blank 62 can intercommunicate with the coupling blank 63. That is, any portion of the casting blank 62 can be used as a pouring opening. Moreover, any portion of the casting blank 62 intercommunicating with the coupling blank 63 can include a plurality of portions according to the design of passage for improving the yield rate of the cast products, which is understood by a person having ordinary skill in the art. Namely, "the hosel-shaping region 62*a* coupled with the second end 632 of the coupling blank 63" is not a limitation but merely a diagrammatic drawing of the present invention.

Next, an enveloping layer 7 is formed on an outer surface of the wax blank 6 by dipping, coating, or clogging. Then, the wax blank 6 and the enveloping layer 7 are heated to melt the wax. As an example, the wax blank 6 and the enveloping layer 7 can be heated in a steam autoclave to melt the wax blank 6, and the molten wax flows out of the enveloping layer 7. The dewaxed enveloping layer 7 is sintered at a high temperature to form the integrally formed shell mold 4 including the crucible portion 41, the coupling portion 43 and the cavity portion 42. A fire-resistant material, such as zirconium silicate, yttrium oxide, stabilized zirconium oxide, or aluminum oxide, can be used as the material for a surface layer of the shell mold 4. A mullite ($3Al_2O_3$-$2SiO_2$) compound or silicon oxide can be used as a fire-resistant material for a back layer of the shell mold 4. In a case that the back layer uses a mullite compound, the mullite compound preferably contains 45-60 wt % of aluminum oxide and 55-40 wt % of silicon oxide. In another case that the back layer uses a silicon oxide compound, the silicon oxide compound preferably contains more than 95% of silicon oxide.

With reference to FIGS. 1 and 3, the heater 5 is mounted in the chamber 11 of the vacuum furnace 1 to heat the crucible portion 41 of the shell mold 4. In this embodiment, the heater 5 can be a high frequency coil and is moved in the chamber 11 by using a lift controller "L." If the crucible portion 41 of the shell mold 4 is to be heated, the heater 5 is moved upward to a preset location surrounding the crucible portion 41 and is activated to heat the crucible portion 41. After heating, the heater 5 is moved downward by the lift controller "L" to a position not surrounding the crucible portion 41, avoiding interference with rotational movement of the shell mold 4 following the rotation of the rotary table 3 and the rotating shaft 2.

The method for manufacturing the low-density wooden golf head according to the present invention can be implemented and includes the following steps.

With reference to FIGS. 1-3, a shell mold 4 is placed on a rotary table 3 connected to a rotating shaft 2 rotatable about a rotating axis. Specifically, the rotary table 3 is mounted in a vacuum furnace 1 to control the vacuum level of the space receiving the shell mold 4. Furthermore, the shell mold 4 includes a crucible portion 41 and a cavity portion 42 in communication with the crucible portion 41 via a coupling portion 43. Thus, the receiving space 411 of the crucible portion 41 is in intercommunication with the at least one cavity 421 of the cavity portion 42. The crucible portion 41 of the shell mold 4 can extend through the receiving hole 321 of the rotary table 3, and the coupling portion 43 abuts the rotary table 3. The cavity portion 42 of the shell mold 4 can be received in the compartment 322 of the rotary table 3, such that the shell mold 4 is reliably positioned in a predetermined location on the rotary table 3.

At least one metal ingot "P" is placed in the receiving space 411 of the crucible portion 41. In a case that the at least one metal ingot includes only one metal ingot "P", the metal ingot "P" is a low-density steel alloy and has a composition identical to a composition of a low-density wooden golf head to be produced. In another case that the at least one metal ingot includes a plurality of metal ingots "P", a composition of the molten metal of the metal ingots "P" is identical to a composition of a low-density wooden golf head to be produced. For instance, two examples of the low-density steel alloy used as the metal ingot "P" are shown, but are not limited thereto, in TABLE 1.

TABLE 1

| | Si | Mn | Cr | C | S | Al | Fe |
|---|---|---|---|---|---|---|---|
| Example 1 | 0.2↓ | 26-29 | 2.6-3.2 | 0.9-1.2 | 0.01↓ | 8.0-9.5 | Bal |

| | Si | Mn | Cr | Ni | Fe |
|---|---|---|---|---|---|
| Example 2 | 3.0-5.5 | 8.0-10.5 | 14.5-17.0 | 3.5-6.0 | Bal |

Referring to TABLE 1, the low-density steel alloy shown as Examples 1 and 2 are iron-based materials containing aluminum (Al), silicon (Si) or manganese (Mn), with the iron having a content of more than 50%, a density of 6.8 g/cm$^3$ and a tensile strength of 145-155 ksi, and belongs to low-density steel materials with a density below 6.5-7.6 g/cm$^3$.

Figure 6:
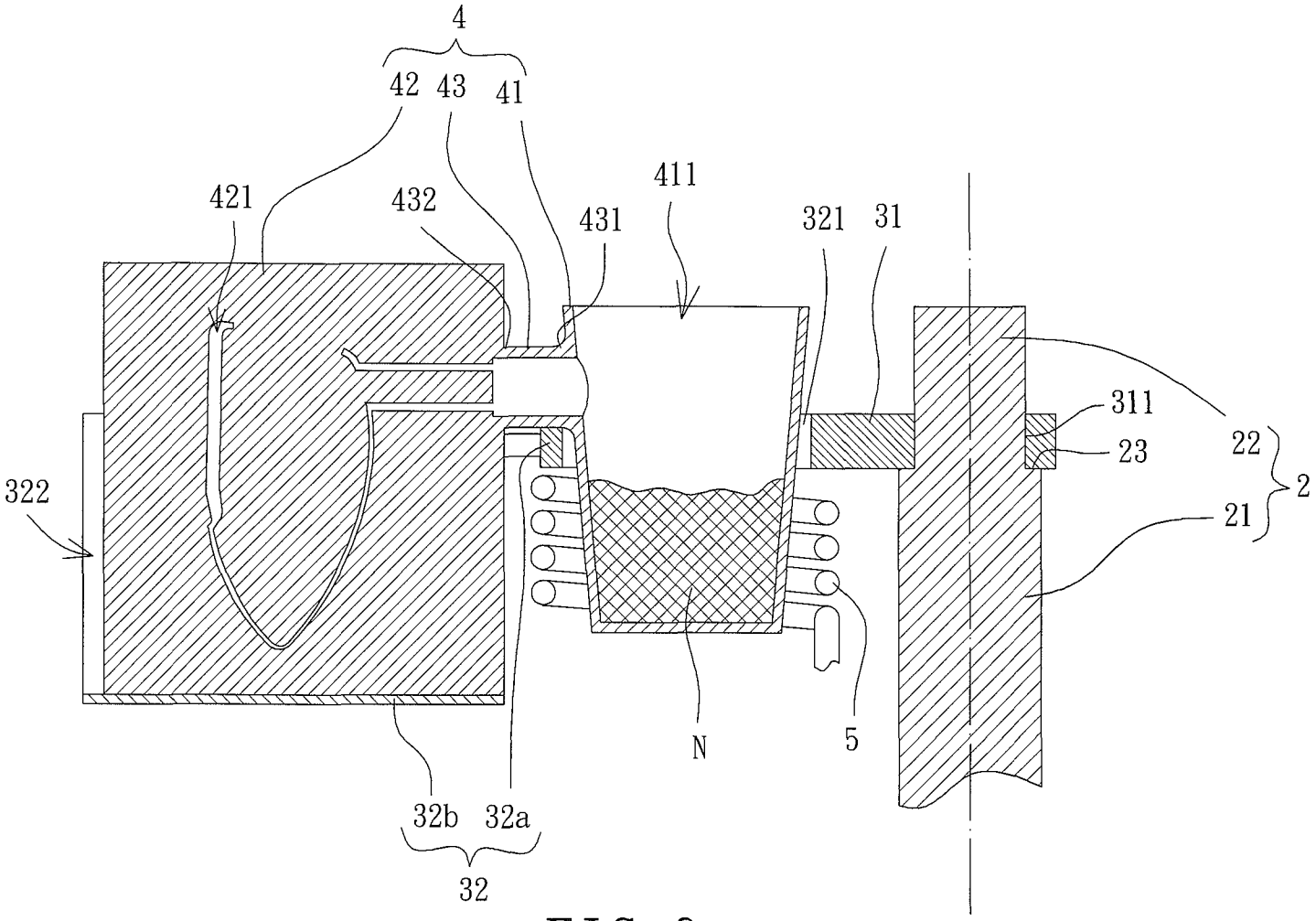
FIG. 6 is a view similar to FIG. 4, illustrating another step of the method according to the present invention.

With reference to FIGS. 1 and 6, the at least one metal ingot "P" is heated in a vacuum environment to be melted into molten metal "N". Specifically, after the shell mold 4 is positioned, the heater 5 can be lifted to the preset location surrounding the crucible portion 41, and the gas in the chamber 11 of the vacuum furnace 1 is drawn out via the gas-guiding tube 12 to control the vacuum level. After the vacuum level reaches a preset value (such as smaller than 0.3 mbar), the heater 5 can be activated to heat the crucible portion 41 of the shell mold 4 and, thus, melt the at least one metal ingot "P" in the crucible portion 41 into molten metal "N". When the heater 5 operates, the frequency and the power of the power supply can be 4-30 kHz and 5-100 kW, respectively. After the at least one metal ingot "P" melts into molten metal "N", the heater 5 is stopped and is rapidly moved downward to a location not surrounding the crucible portion 41.

Figure 7:
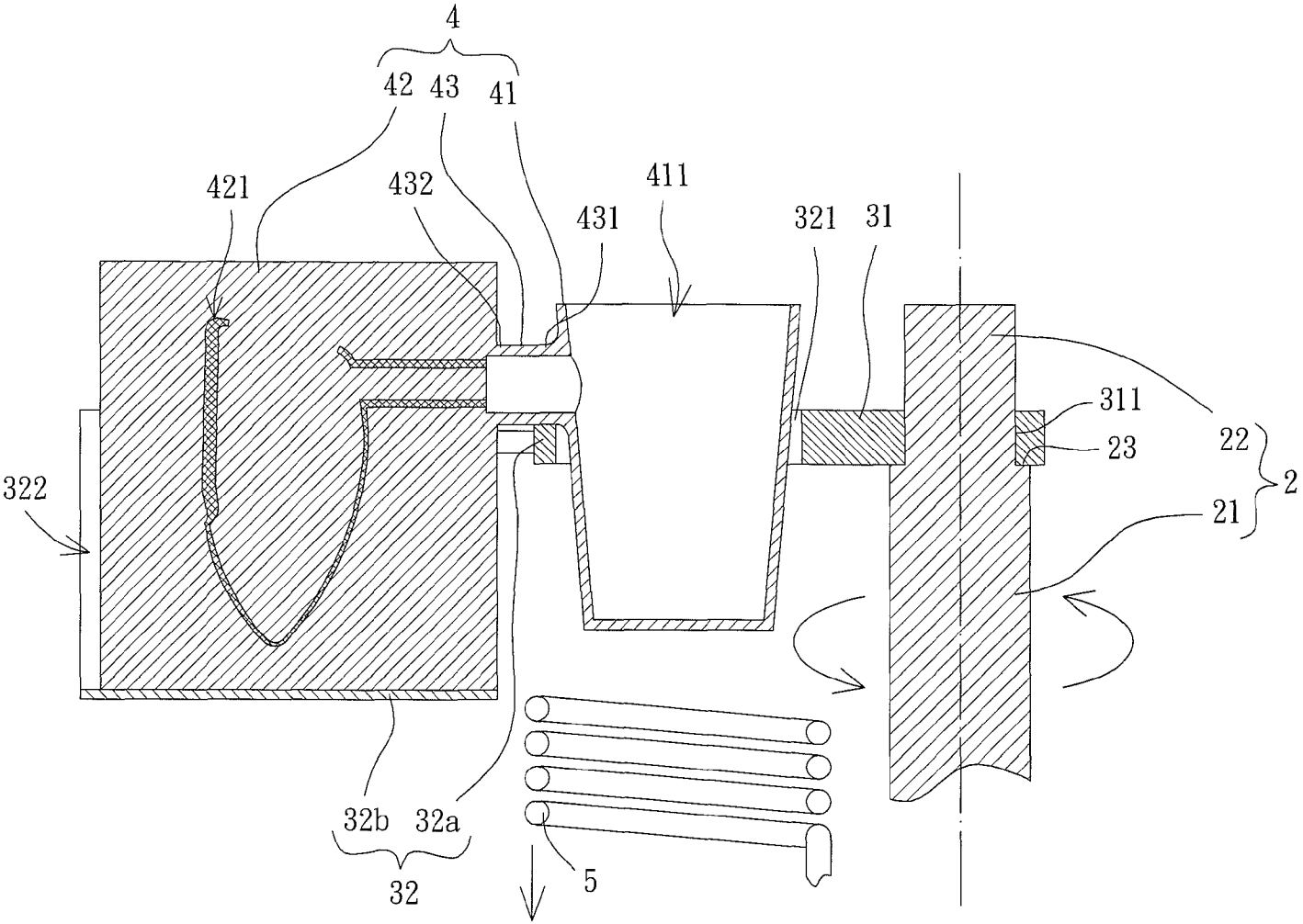
FIG. 7 is a view similar to FIG. 4, illustrating a further step of the method according to the present invention.

With reference to FIGS. 1 and 7, the rotating shaft 2 is driven to rotate the rotary table 3, causing the molten metal "N" to flow into the at least one cavity 421 of the cavity portion 42 under the centrifugal force. Specifically, the rotating shaft 2 is driven by the motor "M" to rotate about the rotating axis at a speed of about 200-700 rpm. The rotating speed can be adjusted according to the thickness of the cast product (i.e., the volume of the at least one cavity 421). When the rotary table 3 is actuated to rotate about the rotating axis, the molten metal "N" flows along the inner periphery of the crucible portion 41 of the shell mold 4 under the centrifugal force and flows into the cavity portion 42 through the coupling portion 43 to proceed with the pouring process and, thus, fill the cavity 421.

After pouring, the rotating shaft 2 is still driven to rotate the rotary table 3. For example, in this embodiment, the rotary table 3 can be driven to rotate about the rotating axis at a speed of about 200-700 rpm for 10-30 seconds until the molten metal "N" at the pouring opening (at internal of the coupling portion 43 of the shell mold 4) cools and solidifies. The rotating of the rotary table 3 is then gradually slowed down and finally stopped. Therefore, during the cooling and solidification process of the molten metal "N" according to the present invention, the pressing effect of the molten metal "N" is evaluated by the centrifugal force generated by the rotation, thereby improving the yield rate of the wooden golf heads.

After the molten metal "N" completely solidifies, the shell meld 4 is destroyed to obtain a casting. For example, the shell mold 4 can be removed from the rotary table 3 after the rotating shaft 2 is completed stopped, and the shell mold 4 can be further destroyed after the shell mold 4 is restricted from movement for a period of time until the molten metal "N" is completely solidified. As a result, pouring of the shell mold 4 is still carried out to improve the manufacturing process. Alternatively, the shell mold 4 can be cooled on the rotary table 3 after the rotary table 3 stops rotating, and the shell mold 4 is removed from the rotary table 3 and destroyed after the molten metal "N" in the shell mold 4 completely solidifies, allowing the even cooling process of the molten metal "N" in the at least one cavity 421.

The casting includes a cast product portion. The cast product portion is separated from the casting (such as by cutting the cast product portion from the casting with a cutter or by vibration to break the cast product portion from the casting) to obtain at least one cast product of the wooden golf head. The at least one cast product of the wooden golf head has a hosel, a crown, a skirt, a heel, a sole and a toe corresponding to the at least one cavity 421. The average thickness of the at least one cast product of the entire wooden golf head is reduced with a minimum thickness of about 0.4-0.6 mm, which is helpful in reducing the overall weight of the at least one wooden golf head.

Thus, the method for manufacturing the low-density wooden golf head according to the present invention can be produced in a nearly vacuum environment to reduce the chemical reaction of the casting material with air during the smelting process, such that the metal ingot "P" can easily and more evenly melt to avoid oxidative fire cracks resulting from reaction with air while the molten metal "N" flows from the crucible portion 41 of the shell mold 4 into the cavity portion 42. Thus, appearance defects, such as sesame dot defects and black bean defects, are less likely to be formed on the cast product of the wooden golf head. Furthermore, casting defects of slag holes or blowholes formed by the reactive gas are less likely to be generated, increasing the tensile strength of the cast product of the wooden golf head.

Furthermore, a reduced chemical reaction between the molten metal "N" and air also increases the flowability of the molten metal "N" in the shell mold 4. Furthermore, the molten metal "N" is reliably poured into the cavity 421 of the shell mold 4 under the centrifugal force before the molten metal "N" re-solidifies, which not only avoids the waste of the casting material due to solidification of a portion of the molten metal "N" in the crucible portion 41 but assures that the cavity portion 42 can be filled with the molten metal "N" after the molten metal "N" flows into the cavity portion 42. The yield rate of the cast products of the wooden golf heads can be increased, and the possibility of formation of gaps in the cast products of the wooden golf heads due to cold shut is reduced. Thus, the tensile strength of the cast products of the wooden golf heads is increased.

In conclusion, the method according to the present invention can be used for manufacturing a low-density cast product of a wooden golf head. Then, the wooden golf head can be further combined with a striking faceplate to undergo a "milling processing" to obtain a low-density steel wooden golf head. The use of low-density steel-type casting material in combination with a vacuum centrifugal casting process can effectively reduce the average thickness of the entire low-density steel wooden golf heads, and can even allow the low-density steel wooden golf heads to have a minimum thickness of 0.4-0.6 mm. As a result, the method for manufacturing the low-density wooden golf head according to the present invention is not only helpful in reducing the entire weight of the wooden golf heads and in improving the hitting effect of the wooden golf heads, but also ensures sufficient structural strength thereof for improved durability.

In view of the foregoing, the method for manufacturing the low-density wooden golf head according to the present invention can reduce the chemical reaction of the casting materials with air during the smelting process, increasing the tensile strength of the cast products and the reduction the average thickness of the wooden golf heads.

Furthermore, the method for manufacturing the low-density wooden golf head according to the present invention can increase the yield rate and the quality of the cast products.

Moreover, the method for manufacturing the low-density wooden golf head according to the present invention can provide the required pressing effect of the molten metal under the centrifugal force during the solidification process of the molten metal "N". Therefore, it is not required to use additional energy to melt additional casting material, such that the method for manufacturing the low-density wooden golf head according to the present invention is capable of reducing the manufacturing cost.

Although the invention has been described in detail with reference to its presently preferable embodiments, it will be understood by one of ordinary skill in the art that various modifications can be made without departing from the spirit and the scope of the invention, as set forth in the appended claims.

What is claimed is:

1. A method for manufacturing a low-density steel wooden golf head comprising:

placing a shell mold on a rotary table, with the shell mold comprising a crucible portion and a cavity portion in communication with the crucible portion via a coupling portion, with the cavity portion comprising a hosel-shaping region, a crown-shaping region, a skirt-shaping region, a heel-shaping region, a sole-shaping region and a toe-shaping region, with the hosel-shaping region, the crown-shaping region, the skirt-shaping region, the heel-shaping region, the sole-shaping region and the toe-shaping region interconnecting with each other;

placing at least one metal ingot in the crucible portion of the shell mold;

melting the at least one metal ingot in the crucible portion of the shell mold into molten metal in a vacuum environment with an activated heater, with the activated heater surrounding the crucible portion of the shell mold and heating the crucible portion;

rotating the rotary table, causing the molten metal to flow into the cavity portion of the shell mold under a centrifugal force generated by rotation;

gradually slowing down the rotary table after the molten metal cools and solidifies;

destroying the shell mold after the molten metal completely solidifies, obtaining a casting comprising a cast product portion; and separating the cast product portion from the casting to obtain at least one casting product of the wooden golf head having a hosel, a crown, a skirt, a heel, a sole and a toe corresponding to the hosel-shaping region, the crown-shaping region, the skirt-shaping region, the heel-shaping region, the sole-shaping region and the toe-shaping region, respectively;

wherein the at least one casting product of the wooden golf head has a density of 6.5-7.6 g/cm$^3$ and a minimum thickness of 0.4-0.6 mm.

2. The method for manufacturing the low-density steel wooden golf head as claimed in claim 1, with placing the shell mold comprising forming the shell mold, with forming the shell mold comprising:

preparing a wax blank comprising a crucible blank and a casting blank, with the wax blank further comprising a coupling blank in communication with an outer periphery of the crucible blank and the casting blank, with the casting blank being a hollow wax shell having an opening connecting an interior thereof;

forming an enveloping layer on an outer surface of the wax blank;

heating the wax blank and the enveloping layer to melt the wax blank; and after heating the wax blank and the enveloping layer, sintering the enveloping layer at a high temperature to form an integrally formed shell mold comprising the crucible portion, the coupling portion and the cavity portion.

3. The method for manufacturing the low-density steel wooden golf head as claimed in claim 2, with preparing the wax blank comprising preparing the wax blank comprising the casting blank comprising a hosel-shaping portion, a heel-shaping portion coupling with the hosel-shaping portion, a sole-shaping portion coupling with the heel-shaping portion and a toe-shaping portion coupling with the sole-shaping portion, with the casting blank further comprising a crown-shaping portion coupling with the hosel-shaping portion and the toe-shaping portion and a skirt-shaping portion coupling with the crown-shaping portion.

4. The method for manufacturing the low-density steel wooden golf head as claimed in claim 3, with preparing the wax blank comprising preparing the wax blank comprising the casting blank having an opening installed among the crown-shaping portion, the heel-shaping portion, the sole-shaping portion and the toe-shaping portion.

5. The method for manufacturing the low-density steel wooden golf head as claimed in claim 1, further comprising:

moving the activated heater upward to a preset location surrounding the crucible portion by a lift controller and moving the activated heater downward to a position not surrounding the crucible portion by the lift controller after the at least one metal ingot is melted into the molten metal.

6. The method for manufacturing the low-density steel wooden golf head as claimed in claim 1, with rotating the rotary table comprising:

rotating the rotary table at a speed of 200-700 rpm to allow the molten metal to flow into the cavity portion of the shell mold and fill the cavity portion of the shell mold.

7. The method for manufacturing the low-density steel wooden golf head as claimed in claim 6, further comprising:

maintaining the speed of the rotary table at 200-700 rpm for 10-30 seconds; and gradually slowing down the speed of the rotary table after the molten metal cools and solidifies.

8. The method for manufacturing the low-density steel wooden golf head as claimed in claim 7, with destroying the shell mold comprising:

removing the shell mold from the rotary table after the rotating table is completely stopped; and restricting the shell mold from movement for a period of time until the molten metal completely solidifies and destroying the shell mold.

9. The method for manufacturing the low-density steel wooden golf head as claimed in claim 7, further comprising:

constantly cooling the shell mold on the rotary table after the rotary table stops rotating; with destroying the shell mold comprising removing the shell mold from the rotary table after the molten metal in the shell mold completely solidifies and destroying the shell mold.

* * * * *